US008393934B2

(12) United States Patent
Sung

(10) Patent No.: US 8,393,934 B2
(45) Date of Patent: Mar. 12, 2013

(54) CMP PAD DRESSERS WITH HYBRIDIZED ABRASIVE SURFACE AND RELATED METHODS

(76) Inventor: Chien-Min Sung, Tansui (TW)

( * ) Notice: Subject to any disclaimer, the term of this patent is extended or adjusted under 35 U.S.C. 154(b) by 999 days.

(21) Appl. No.: 12/255,823

(22) Filed: Oct. 22, 2008

(65) Prior Publication Data

US 2009/0093195 A1 Apr. 9, 2009

Related U.S. Application Data

(63) Continuation-in-part of application No. 12/168,110, filed on Jul. 5, 2008, and a continuation-in-part of application No. 11/560,817, filed on Nov. 16, 2006, now Pat. No. 7,762,872.

(60) Provisional application No. 60/976,198, filed on Sep. 28, 2007.

(51) Int. Cl.
*B24B 1/00* (2006.01)

(52) U.S. Cl. ..... 451/56; 451/443

(58) Field of Classification Search ..... 451/56, 451/443, 444
See application file for complete search history.

(56) References Cited

U.S. PATENT DOCUMENTS

| | | | |
|---|---|---|---|
| 187,593 | A | 2/1877 | Brown et al. |
| 1,854,071 | A | 4/1932 | Schacht |
| 1,988,065 | A | 1/1935 | Wooddell |
| 2,027,087 | A | 1/1936 | Buckner |
| 2,027,307 | A | 1/1936 | Schacht |
| 2,033,991 | A | 3/1936 | Melton |
| 2,035,521 | A | 3/1936 | Benner |
| RE20,660 | E | 2/1938 | Schacht |
| 2,184,348 | A | 12/1939 | Kirchner |
| 2,187,624 | A | 1/1940 | Melton |
| 2,194,253 | A | 3/1940 | Benner |
| 2,268,663 | A | 1/1942 | Kuzmick |
| 2,281,558 | A | 5/1942 | Cross |
| 2,318,570 | A | 5/1943 | Carlton |
| 2,334,572 | A | 11/1943 | Melton |
| 2,612,348 | A | 9/1952 | Catallo |
| 2,725,693 | A | 12/1955 | Smith |
| 2,811,960 | A | 11/1957 | Fessel |
| 2,867,086 | A | 1/1959 | Haley |
| 2,876,086 | A | 3/1959 | Raymond |
| 2,947,608 | A | 8/1960 | Hall |
| 2,652,951 | A | 9/1960 | Simpson |
| 2,952,951 | A | 9/1960 | Simpson |
| 3,067,551 | A | 12/1962 | Maginnis |

(Continued)

FOREIGN PATENT DOCUMENTS

| | | |
|---|---|---|
| CN | 1351922 | 6/2002 |
| CN | 1494984 | 5/2004 |

(Continued)

OTHER PUBLICATIONS

U.S. Appl. No. 12/715,583, filed Mar. 2, 2010; Chien-Min Sung; office action issued Oct. 25, 2011.

(Continued)

*Primary Examiner* — Maurina Rachuba
(74) *Attorney, Agent, or Firm* — Thorpe North & Western LLP

(57) ABSTRACT

A CMP pad conditioner comprises a plurality of abrasive segments. Each abrasive segment includes a segment blank and an abrasive layer attached to the segment blank, the abrasive layer including a superhard abrasive material. A pad conditioner substrate is also provided. Each of the plurality of abrasive segments is permanently affixed to the pad conditioner substrate in an orientation that enables removal of material from a CMP pad by the abrasive layer as the pad conditioner and the CMP pad are moved relative to one another.

20 Claims, 4 Drawing Sheets

U.S. PATENT DOCUMENTS 3,121,981 A 2/1964 Hurst
3,127,715 A 4/1964 Christensen
3,146,560 A 9/1964 Hurst
3,276,852 A 10/1966 Lemelson
3,293,012 A 12/1966 Smiley
3,372,010 A 3/1968 Parsons
3,377,411 A 4/1968 Charvat
3,416,560 A 12/1968 Bruno
3,440,774 A 4/1969 Cum
3,608,134 A 9/1971 Cook
3,625,666 A 12/1971 James
3,631,638 A 1/1972 Yoshikawa et al.
2,078,354 A 4/1973 Webster
3,743,489 A 7/1973 Wentorf et al.
3,767,371 A 10/1973 Wentorf, Jr. et al.
3,802,130 A 4/1974 Lindenbeck
3,819,814 A 6/1974 Pope
3,852,078 A 12/1974 Wakatsuki et al.
3,894,673 A 7/1975 Lowder et al.
3,982,358 A 9/1976 Fukuda
4,018,576 A 4/1977 Lowder et al.
4,078,906 A 3/1978 Green
4,149,881 A 4/1979 D'Silva
4,155,721 A 5/1979 Fletcher
4,182,628 A 1/1980 D'Silva
4,188,194 A 2/1980 Corrigan
4,201,601 A 5/1980 D'Silva
4,211,294 A 7/1980 Multakh
4,211,924 A 7/1980 Muller et al.
4,224,380 A 9/1980 Bovenkerk et al.
4,228,214 A 10/1980 Steigelman et al.
4,229,186 A 10/1980 Wilson
4,273,561 A 6/1981 Villalobos
4,287,168 A 9/1981 Wentorf et al.
4,289,503 A 9/1981 Corrigan
4,341,532 A 7/1982 Oide
4,355,489 A 10/1982 Heyer et al.
4,481,016 A 11/1984 Campbell et al.
4,525,179 A 6/1985 Gigl
4,547,257 A 10/1985 Iizuka et al.
4,551,195 A 11/1985 Iizuka et al.
4,565,034 A 1/1986 Sekiya
4,610,699 A 9/1986 Yazu et al.
4,617,181 A 10/1986 Yazu et al.
4,629,373 A 12/1986 Hall
4,632,817 A 12/1986 Yazu et al.
4,662,896 A 5/1987 Dennis
4,669,522 A 6/1987 Griffin
4,680,199 A 7/1987 Vontell et al.
4,712,552 A 12/1987 Pangburn
4,749,514 A 6/1988 Murakami et al.
4,776,861 A 10/1988 Frushour
4,780,274 A 10/1988 Barr
4,797,241 A 1/1989 Peterson et al.
4,828,582 A 5/1989 Frushour
4,849,602 A 7/1989 Gardner
4,866,888 A 9/1989 Murai et al.
4,883,500 A 11/1989 Deakins et al.
4,908,046 A 3/1990 Wiand
4,916,869 A 4/1990 Oliver
4,923,490 A 5/1990 Johnson et al.
4,925,457 A 5/1990 deKok et al.
4,927,619 A 5/1990 Tsuji
4,943,488 A 7/1990 Sung et al.
4,945,686 A 8/1990 Wiand
4,949,511 A 8/1990 Endo et al.
4,954,139 A 9/1990 Cerutti
4,968,326 A 11/1990 Wiand
5,000,273 A 3/1991 Horton et al.
5,011,513 A 4/1991 Zador et al.
5,022,895 A 6/1991 Wiand
5,024,680 A 6/1991 Chen et al.
5,030,276 A 7/1991 Sung et al.
5,037,451 A 8/1991 Burnand et al.
5,043,120 A 8/1991 Corrigan
5,049,165 A 9/1991 Tselesin
5,092,082 A 3/1992 Padberg
5,092,910 A 3/1992 deKok et al.
5,116,568 A 5/1992 Sung
5,131,924 A 7/1992 Wiand
5,133,782 A 7/1992 Wiand
5,137,543 A 8/1992 Heath et al.
5,151,107 A 9/1992 Cho et al.
5,164,247 A 11/1992 Solanki et al.
5,176,155 A 1/1993 Rudolph, Jr.
5,190,568 A 3/1993 Tselesin
5,194,070 A 3/1993 Sumiya et al.
5,194,071 A 3/1993 Corrigan
5,195,403 A 3/1993 Sani et al.
5,195,404 A 3/1993 Notter et al.
5,197,249 A 3/1993 Wiand
5,203,881 A 4/1993 Wiand
5,232,320 A 8/1993 Tank et al.
5,243,790 A 9/1993 Gagne
5,247,765 A 9/1993 Quintana
5,248,317 A 9/1993 Tank
5,264,011 A 11/1993 Brown et al.
5,266,236 A 11/1993 Bovenkerk
5,271,547 A 12/1993 Carlson
5,273,730 A 12/1993 Yoshida et al.
5,295,402 A 3/1994 Bovenkerk
5,314,513 A 5/1994 Miller et al.
5,328,548 A 7/1994 Tsuji et al.
5,364,423 A 11/1994 Bigelow et al.
5,374,293 A 12/1994 Takashita et al.
5,380,390 A * 1/1995 Tselesin ..... 156/230
5,443,032 A 8/1995 Vichr et al.
5,453,106 A 9/1995 Roberts
5,454,343 A 10/1995 Eun et al.
5,458,754 A 10/1995 Sathrum et al.
5,486,131 A 1/1996 Cesna et al.
5,492,771 A 2/1996 Lowder et al.
5,496,386 A 3/1996 Broberg et al.
5,500,248 A 3/1996 Iacovangelo et al.
5,505,272 A 4/1996 Clark
5,518,443 A 5/1996 Fisher
5,527,424 A * 6/1996 Mullins ..... 438/692
5,536,202 A * 7/1996 Appel et al. ..... 451/285
5,547,417 A 8/1996 Breivogel et al.
5,551,959 A 9/1996 Martin et al.
5,560,745 A 10/1996 Roberts
5,560,754 A 10/1996 Johnson et al.
5,609,286 A 3/1997 Anthon
5,620,489 A 4/1997 Tselesin
5,660,894 A 8/1997 Chen et al.
5,669,943 A 9/1997 Horton et al.
5,674,572 A 10/1997 Sarin et al.
5,725,421 A 3/1998 Goers et al.
5,746,931 A 5/1998 Graebner et al.
RE35,812 E 6/1998 Oliver
5,772,756 A 6/1998 Davies et al.
5,776,214 A 7/1998 Wood
5,779,743 A 7/1998 Wood
5,791,975 A 8/1998 Cesna et al.
5,801,073 A 9/1998 Robbins et al.
5,816,891 A 10/1998 Woo
5,820,450 A 10/1998 Calhoun
5,833,519 A 11/1998 Moore
5,851,138 A 12/1998 Hempel, Jr.
5,855,314 A 1/1999 Shiue et al.
5,885,137 A 3/1999 Ploessl
5,902,173 A 5/1999 Tanaka
5,916,011 A 6/1999 Kim et al.
5,919,084 A 7/1999 Powell et al.
5,921,856 A 7/1999 Zimmer
5,924,917 A 7/1999 Benedict et al.
5,961,373 A 10/1999 Lai et al.
5,975,988 A 11/1999 Christianson
5,976,001 A 11/1999 Powell et al.
5,976,205 A 11/1999 Andrews et al.
5,980,852 A 11/1999 Burns et al.
5,980,982 A 11/1999 Degawa et al.
5,985,228 A 11/1999 Corrigan et al.
6,001,008 A 12/1999 Fujimori et al.
6,001,174 A 12/1999 Fang
6,024,824 A 2/2000 Krech
6,027,659 A 2/2000 Billett 6,030,595 A 2/2000 Sumiya et al.
6,039,641 A 3/2000 Sung
6,054,183 A 4/2000 Zimmer et al.
6,093,280 A 7/2000 Kirchner et al.
6,106,382 A 8/2000 Sakaguchi
6,123,612 A 9/2000 Goers
6,159,286 A 12/2000 Sung
6,179,886 B1 1/2001 Gordeev et al.
6,190,240 B1 2/2001 Kinoshita et al.
6,196,911 B1 * 3/2001 Preston et al. ..... 451/548
6,206,942 B1 3/2001 Wood
6,213,856 B1 * 4/2001 Cho et al. ..... 451/443
6,217,413 B1 4/2001 Christianson
6,224,469 B1 5/2001 Ohmori et al.
6,258,138 B1 7/2001 DeVoe et al.
6,258,201 B1 7/2001 Krech
6,258,237 B1 7/2001 Gal-Or et al.
6,277,304 B1 8/2001 Wei et al.
6,281,129 B1 8/2001 Easter et al.
6,284,556 B1 9/2001 Wang et al.
6,286,498 B1 9/2001 Sung
6,293,854 B1 9/2001 Kimura et al.
6,299,508 B1 10/2001 Gagliardi et al.
6,319,108 B1 11/2001 Adefris et al.
6,325,709 B1 12/2001 Nanda et al.
6,346,202 B1 2/2002 Molnar
6,354,918 B1 3/2002 Togawa et al.
6,354,929 B1 3/2002 Adefris et al.
6,368,198 B1 4/2002 Sung et al.
6,371,838 B1 4/2002 Holzapfel
6,371,842 B1 * 4/2002 Romero ..... 451/540
6,394,886 B1 5/2002 Chen et al.
6,409,580 B1 6/2002 Lougher et al.
6,439,986 B1 8/2002 Myoung et al.
6,446,740 B2 9/2002 Eyre
6,458,018 B1 10/2002 Goers et al.
6,478,831 B2 11/2002 Tselesin
6,497,853 B1 12/2002 Davies et al.
6,544,599 B1 4/2003 Brown et al.
6,551,176 B1 4/2003 Garretson
6,607,423 B1 8/2003 Arcayan et al.
6,616,725 B2 9/2003 Cho et al.
6,626,167 B2 9/2003 Kim et al.
6,627,168 B1 9/2003 Ohtsubo et al.
6,629,884 B1 10/2003 Goers
6,672,943 B2 * 1/2004 Vogtmann et al. ..... 451/41
6,679,243 B2 1/2004 Sung
6,694,847 B2 2/2004 Hiroyasu et al.
6,722,952 B2 4/2004 Goers et al.
6,749,485 B1 6/2004 James et al.
6,755,720 B1 6/2004 Ishizaki et al.
6,790,126 B2 9/2004 Wood et al.
6,818,029 B2 11/2004 Myoung et al.
6,824,455 B2 11/2004 Osterheld et al.
6,835,365 B1 12/2004 Davies et al.
6,884,155 B2 4/2005 Sung et al.
6,899,592 B1 5/2005 Kojima et al.
6,905,571 B2 6/2005 Sakuma et al.
6,945,857 B1 9/2005 Doan et al.
6,979,357 B2 12/2005 Fries et al.
7,021,995 B2 4/2006 Toge et al.
7,033,408 B2 4/2006 Fries et al.
7,044,990 B2 5/2006 Ishizaki et al.
7,066,795 B2 6/2006 Balagani et al.
7,124,753 B2 10/2006 Sung
7,150,677 B2 12/2006 Yamashita et al.
7,198,553 B2 4/2007 Goers
7,201,645 B2 4/2007 Sung
7,247,577 B2 7/2007 Palmgren et al.
7,258,708 B2 8/2007 Sung
7,261,621 B2 * 8/2007 Moon et al. ..... 451/287
7,323,049 B2 1/2008 Sung
7,368,013 B2 5/2008 Sung
7,384,436 B2 6/2008 Sung
7,404,857 B2 7/2008 Sung
7,465,217 B2 12/2008 Kinoshita et al.
7,585,366 B2 9/2009 Sung
7,641,538 B2 1/2010 Goers
7,651,386 B2 1/2010 Sung
7,658,666 B2 2/2010 Sung
7,690,971 B2 4/2010 Sung
7,840,305 B2 11/2010 Behr et al.
8,104,464 B2 1/2012 Sung
2001/0003884 A1 6/2001 Wei et al.
2001/0009844 A1 7/2001 Cho et al.
2002/0042200 A1 4/2002 Fawcett
2002/0127962 A1 * 9/2002 Cho et al. ..... 451/443
2002/0164928 A1 11/2002 Tolles
2002/0173234 A1 11/2002 Sung et al.
2003/0054746 A1 3/2003 Nussbaumer et al.
2003/0084894 A1 5/2003 Sung
2003/0114094 A1 6/2003 Myoung et al.
2003/0207659 A1 11/2003 Annen et al.
2004/0009742 A1 1/2004 Lin et al.
2004/0060243 A1 4/2004 Fries et al.
2004/0079033 A1 4/2004 Long
2004/0091627 A1 5/2004 Ohara et al.
2004/0107648 A1 6/2004 Sung
2004/0180617 A1 9/2004 Goers
2004/0203325 A1 * 10/2004 Donohue ..... 451/56
2005/0032462 A1 2/2005 Gagliardi et al.
2005/0060941 A1 3/2005 Provow et al.
2005/0118939 A1 6/2005 Duescher
2005/0215188 A1 9/2005 Toge et al.
2005/0260939 A1 11/2005 Andrews et al.
2006/0073774 A1 4/2006 Sung
2006/0079160 A1 * 4/2006 Balagani et al. ..... 451/285
2006/0079162 A1 * 4/2006 Yamashita et al. ..... 451/444
2006/0128288 A1 6/2006 An et al.
2006/0135050 A1 6/2006 Petersen et al.
2006/0143991 A1 7/2006 Sung
2006/0254154 A1 11/2006 Huang et al.
2006/0258276 A1 11/2006 Sung
2007/0051354 A1 3/2007 Sung
2007/0051355 A1 3/2007 Sung
2007/0060026 A1 3/2007 Sung
2007/0066194 A1 3/2007 Wielonski et al.
2007/0093181 A1 4/2007 Lugg et al.
2007/0128994 A1 6/2007 Sung
2007/0155298 A1 7/2007 Sung
2007/0249270 A1 10/2007 Sung
2007/0254566 A1 11/2007 Sung
2007/0264918 A1 11/2007 Sung
2007/0266639 A1 11/2007 Sung
2007/0295267 A1 12/2007 Sung
2008/0076338 A1 3/2008 Andrews et al.
2008/0096479 A1 4/2008 Sung
2008/0153398 A1 6/2008 Sung
2008/0171503 A1 7/2008 Sung
2008/0271384 A1 11/2008 Puthanangady et al.
2008/0292869 A1 11/2008 Sung
2009/0068937 A1 3/2009 Sung
2009/0093195 A1 4/2009 Sung
2009/0145045 A1 6/2009 Sung
2009/0283089 A1 11/2009 Sung
2010/0015898 A1 1/2010 An et al.
2010/0139174 A1 6/2010 Sung
2010/0186479 A1 7/2010 Borucki et al.
2010/0203811 A1 * 8/2010 Philipossian et al. ..... 451/72
2010/0221990 A1 9/2010 Sung
2010/0248595 A1 9/2010 Dinh-Ngoc
2010/0248596 A1 9/2010 Sung
2010/0261419 A1 10/2010 Sung
2011/0212670 A1 9/2011 Sung
2011/0275288 A1 11/2011 Sung
2011/0296766 A1 12/2011 Sung

FOREIGN PATENT DOCUMENTS

EP 0712941 5/1966
EP 0238434 3/1987
EP 0280657 8/1988
EP 0331344 2/1989
EP 0264674 9/1995
EP 1075898 2/2001
GB 2239011 6/1991
JP 06182184 4/1994
JP 10128654 5/1998
JP 10180618 7/1998

| | | |
|---|---|---|
| JP | 11048122 | 2/1999 |
| JP | 11077536 | 3/1999 |
| JP | 200167774 | 6/2000 |
| JP | 2000343436 | 12/2000 |
| JP | 2003-071718 | 3/2003 |
| JP | 2004/025401 | 1/2004 |
| JP | 2007-044823 | 2/2007 |
| KR | 20-0339181 | 1/2004 |
| WO | WO 94/27883 | 12/1994 |
| WO | WO 95/27596 | 10/1995 |
| WO | WO 96/06732 | 3/1996 |
| WO | WO 98/10897 | 3/1998 |
| WO | WO 98/45091 | 3/1998 |
| WO | WO 98/51448 | 3/1998 |
| WO | WO 98/45092 | 10/1998 |
| WO | WO 02/31078 | 4/2002 |
| WO | WO2004/094106 | 11/2004 |
| WO | WO 2006/124792 | 11/2006 |
| WO | WO 2007/032946 | 3/2007 |
| WO | WO 2008/063599 | 5/2008 |

OTHER PUBLICATIONS

Sung, U.S. Appl. No. 11/804,221, filed May 16, 2007. Office Action issued on Jan. 16, 2009.
U.S. Appl. No. 12/328,338, filed Dec. 4, 2008; Chien-Min Sung; office action issued May 10, 2011.
U.S. Appl. No. 13/021,350, filed Feb. 4, 2011; Chien-Min Sung; office action issued Aug. 31, 2011.
U.S. Appl. No. 11/512,755, filed Aug. 29, 2006, Chien-Min Sung. Office action issued Oct. 13, 2009.
Syndite, CTM302. Announcement, elementsix Advancing Diamond. Jan. 14, 2003. http://www.e6.com/en/resourcestannouncementsheets/CTM302.pdf. As accessed on Dec. 16, 2008.
PCT Application PCT/US2007/024165; filed Nov. 16, 2007; Chien-Min Sung; International Search Report mailed May 23, 2011.
U.S. Appl. No. 12/255,823, filed Oct. 22, 2005; Chien-Min Sung; office action issued Mar. 7, 2012.
U.S. Appl. No. 12/168,110, filed Jul. 5, 2008; Chien-Min Sung; office action issued May 14, 2012.
U.S. Appl. No. 12/715,583, filed Mar. 2, 2010; Chien-Min Sung; office action issued Mar. 21, 2012.
U.S. Appl. No. 13/021,350, filed Feb. 4, 2011; Chien-Min Sung; office action issued Feb. 7, 2012.
U.S. Appl. No. 12/267,172, filed Nov. 7, 2008; Chien-Min Sung; office action issued Jan. 3, 2012.
Colmonoy Technical Data Sheet; No. DSP-A; 1993.
Endecott's Specifications; 2004.
Kennametal Specification for DMHPM002 Hot Press Matrix N-50 Dec. 6, 2001.
Material Safety Data Sheet (MSDS), Wall Colmonoy Corporation; prepared Jul. 20, 1989.
Material Safety Data Sheet MSDS); Kennametal; issued Jun. 11, 2004.
Sung et al.; The Eastern Wind of Diamond Synthesis; New Diamond and Frontier Carpon Technology; 2003; pp. 47-61; vol. 13, No. 1.
Sung et al; Mechanism of the Solvent-Assisted Graphite to Diamond Transition Under High Pressure: Implications for the Selection of Catalysts, High Temperatures-High Pressure; 1995/1996; pp. 523-546; vol. 27/28.
Syndite, Elementsix Advancing Diamond; 2 pages.
U.S. Appl. No. 08/832,852, filed Apr. 4, 1997; Chien-Min Sung.
U.S. Appl. No. 09/447,620, filed Nov. 22, 1999; Chien-Min Sung.
Yasinaga et al; Advances in Abrasive Technology, III; Soc. Of Grinding Engineers (SGE) in Japan; 2000.
U.S. Appl. No. 11/512/755, filed Aug. 29, 2006; Chien-Min Sung.
U.S. Appl. No. 13/021,350, filed Feb. 4, 2011; Chien-Min Sung; office action issued Aug. 10, 2012.
U.S. Appl. No. 12/715,583, filed Mar. 2, 2010; Chien-Min Sung; office action issued Aug. 9, 2012.
U.S. Appl. No. 12/267,172, filed Nov. 7, 2008; Chien-Min Sung; office action issued Jul. 9, 2012.
U.S. Appl. No. 13/362,917, filed Jan. 31, 2012; Chien-Min Sung; office action issued Jun. 14, 2012.
U.S. Appl. No. 12/255,823, filed Oct. 22, 2008; Chien-Min Sung; notice of allowance issued Sep. 21, 2012.
U.S. Appl. No. 12/267,172, filed Nov. 7, 2008; Chien-Min Sung; notice of allowance dated Oct. 22, 2012.
U.S. Appl. No. 12/328,338, filed Dec. 4, 2008, Chien-Min Sung, Office Action issued Jan. 3, 2011.
U.S. Appl. No. 11/805,549, filed May 22, 2007, Chien-Min Sung, Office Action issued Oct. 6, 2010.
U.S. Appl. No. 12/715,583, filed Mar. 2, 2010; Chien-Min Sung; notice of allowance dated Dec. 7, 2012.
PCT/US2012/039199; filed May 23, 2012; Chien-Min Sung; International Search Report dated Dec. 18, 2012.
U.S. Appl. No. 13/362,917, filed Jan. 13, 2012; Chien-Min Sung; office action dated Dec. 31, 2012.
U.S. Appl. No. 12/267,172, filed Nov. 7, 2008; Chien-Min Sung; notice of allowance dated Jan. 7, 2013.
U.S. Appl. No. 12/168,110, filed Jul. 5, 2008; Chien-Min Sung; notice of allowance dated Jan. 18, 2013.

* cited by examiner

CMP PAD DRESSERS WITH HYBRIDIZED ABRASIVE SURFACE AND RELATED METHODS

PRIORITY CLAIM

This application is a continuation in part of copending U.S. patent application Ser. No. 12/168,110, filed on Jul. 5, 2008, which claims the benefit of U.S. Provisional Patent Application Ser. No. 60/976,198, filed Sep. 28, 2007; this application is also a continuation-in-part of U.S. patent application Ser. No. 11/560,817, filed Nov. 16, 2006 now U.S. Pat. No. 7,762,872, each of which are hereby incorporated herein by reference.

FIELD OF THE INVENTION

The present invention relates generally to CMP pad conditioners used to remove material from (e.g., smooth, polish, dress, etc.) CMP pads. Accordingly, the present invention involves the fields of chemistry, physics, and materials science.

BACKGROUND OF THE INVENTION

The semiconductor industry currently spends in excess of one billion U.S. Dollars each year manufacturing silicon wafers that must exhibit very flat and smooth surfaces. Known techniques to manufacture smooth and even-surfaced silicon wafers are plentiful. The most common of these involves the process known as Chemical Mechanical Polishing (CMP) which includes the use of a polishing pad in combination with an abrasive slurry. Of central importance in all CMP processes is the attainment of high performance levels in aspects such as uniformity of polished wafer, smoothness of the IC circuitry, removal rate for productivity, longevity of consumables for CMP economics, etc.

SUMMARY OF THE INVENTION

In accordance with one embodiment, the present invention provides a CMP pad conditioner, including a plurality of abrasive segments. In one aspect, for example, a CMP pad conditioner is provided including a plurality of blade abrasive segments, where each blade abrasive segment includes an elongated blade segment blank and an abrasive layer attached to the blade segment blank, the abrasive layer including a superhard abrasive material. The conditioner can also include a plurality of particle abrasive segments, where each particle abrasive segment includes a particle segment blank and an abrasive layer attached to the particle segment blank, the abrasive layer including a plurality of superabrasive particles. Furthermore, the conditioner can include a pad conditioner substrate, where each of the plurality of blade abrasive segments and the particle abrasive segments are permanently affixed to the pad conditioner substrate in an alternating pattern and in an orientation that enables removal of material from a CMP pad by the abrasive layers as the pad conditioner and the CMP pad are moved relative to one another.

In another aspect of the present invention, a method of conditioning a CMP pad surface is provided. Such a method can include moving a dresser surface and the CMP pad surface relative to one another, such that the dresser surface alternately shaves and furrows the CMP pad surface.

In yet another aspect, a method of forming a CMP pad conditioner can include positioning a plurality of blade abrasive segments and a plurality of particle abrasive segments as described in an alternating arrangement on a face of a pad conditioner substrate in an orientation that enables removal of material from a CMP pad by the abrasive layers as the pad conditioner and the CMP pad are moved relative to one another. The method can further include permanently affixing the plurality of blade abrasive segments and the plurality of particle abrasive segments to the pad conditioner substrate.

There has thus been outlined, rather broadly, various features of the invention so that the detailed description thereof that follows may be better understood, and so that the present contribution to the art may be better appreciated. Other features of the present invention will become clearer from the following detailed description of the invention, taken with any accompanying or following claims, or may be learned by the practice of the invention.

Figure 1:
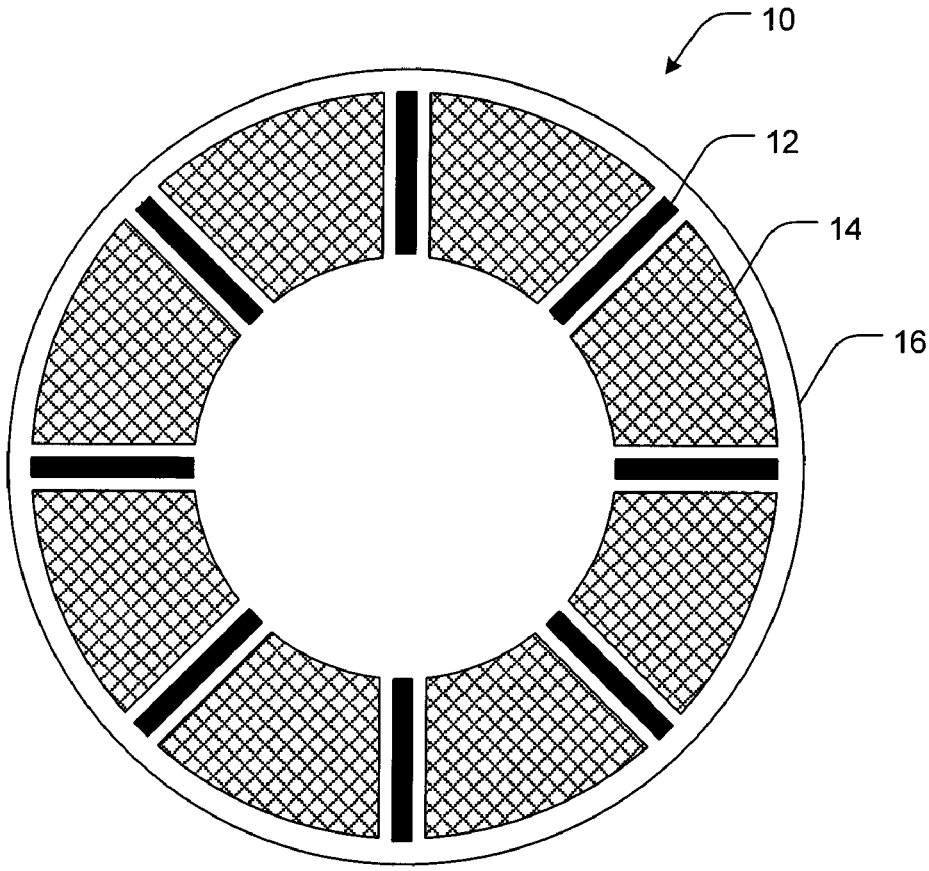
FIG. 1 is a schematic, top plan view of an exemplary pad conditioner in accordance with an embodiment of the invention.

It will be understood that the above figures are merely for illustrative purposes in furthering an understanding of the invention. Further, the figures may not be drawn to scale, thus dimensions, particle sizes, and other aspects may, and generally are, exaggerated to make illustrations thereof clearer. For example, an abrasive layer is illustrated in some of the figures as including a plurality of abrasive particles: however, many of the specific embodiments disclosed herein do not necessarily include abrasive particles. Therefore, it will be appreciated that departure can and likely will be made from the specific dimensions and aspects shown in the figures in order to produce the pad conditioners of the present invention.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and any appended or following claims, the singular forms “a,” “an”

and "the" include plural referents unless the context clearly dictates otherwise. Thus, for example, reference to "an abrasive segment" can include one or more of such segments.

Definitions

In describing and claiming the present invention, the following terminology will be used in accordance with the definitions set forth below.

All mesh sizes that may be referred to herein are U.S. mesh sizes unless otherwise indicated. Further, mesh sizes are generally understood to indicate an average mesh size of a given collection of particles since each particle within a particular "mesh size" may actually vary over a small distribution of sizes.

As used herein, the term "substantially" refers to the complete or nearly complete extent or degree of an action, characteristic, property, state, structure, item, or result. As an arbitrary example, when two or more objects are referred to as being spaced a "substantially" constant distance from one another, it is understood that the two or more objects are spaced a completely unchanging distance from one another, or so nearly an unchanging distance from one another that a typical person would be unable to appreciate the difference. The exact allowable degree of deviation from absolute completeness may in some cases depend upon the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As an arbitrary example, a cavity that is "substantially free of" foreign matter would either completely lack any foreign matter, or so nearly completely lack foreign matter that the effect would be the same as if it completely lacked foreign matter. In other words, a cavity that is "substantially free of" foreign matter may still actually contain minute portions of foreign matter so long as there is no measurable effect upon the cavity as a result thereof.

As used herein, a pad conditioner "substrate" means a portion of a pad conditioner that supports abrasive materials, and to which abrasive materials and/or segment blanks that carry abrasive materials may be affixed. Substrates useful in the present invention may of a variety of shapes, thicknesses, or materials that are capable of supporting abrasive materials in a manner that is sufficient to provide a pad conditioner useful for its intended purpose. Substrates may be of a solid material, a powdered material that becomes solid when processed, or a flexible material. Examples of typical substrate materials include without limitation, metals, metal alloys, ceramics, relatively hard polymers or other organic materials, glasses, and mixtures thereof. Further, the substrate may include a material that aids in attaching abrasive materials to the substrate, including, without limitation, brazing alloy material, sintering aids and the like.

As used herein, "segment blank" refers to a structure similar in many respects to the pad conditioner substrates defined above. Segment blanks are utilized in the present invention to carry abrasive layers: attachment of the abrasive layers to the pad conditioner substrates is typically achieved by way of attaching the segment blanks to the pad conditioner substrates. It is important to note that a variety of techniques of attaching the segment blanks to the substrates, and a variety of techniques of attaching the abrasive layers to the segment blanks, are discussed herein. It is to be understood that all of these various attachment mechanisms can be used interchangeably herein: that is, if a method of attaching a segment blank to a substrate is discussed herein, the method of attachment discussed can also be used to attach an abrasive layer to a segment blank. For any particular CMP pad dresser being discussed, however, it is understood that attachment methods of the abrasive layers to the segment blanks can differ from, or can be the same as, the method used to attach the segment blanks to the pad conditioner substrate.

As used herein, "geometric configuration" refers to a shape that is capable of being described in readily understood and recognized mathematical terms. Examples of shapes qualifying as "geometric configurations" include, without limitation, cubic shapes, polyhedral (including regular polyhedral) shapes, triangular shapes (including equilateral triangles, isosceles triangles and three-dimensional triangular shapes), pyramidal shapes, spheres, rectangles, "pie" shapes, wedge shapes, octagonal shapes, circles, etc.

As used herein, "vapor deposition" refers to a process of depositing materials on a substrate through the vapor phase. Vapor deposition processes can include any process such as, but not limited to, chemical vapor deposition (CVD) and physical vapor deposition (PVD). A wide variety of variations of each vapor deposition method can be performed by those skilled in the art. Examples of vapor deposition methods include hot filament CVD, rf-CVD, laser CVD (LCVD), metal-organic CVD (MOCVD), sputtering, thermal evaporation PVD, ionized metal PVD (IMPVD), electron beam PVD (EBPVD), reactive PVD, and the like.

As used herein, "abrasive profile" is to be understood to refer to a shape, configuration, or a space defined by abrasive materials that can be used to remove material from a CMP pad. Examples of abrasive profiles include, without limitation, rectangular shapes, tapering rectangular shapes, truncated wedge shapes, wedge shapes, a "saw tooth" profile and the like. In some embodiments, the abrasive profile exhibited by abrasive segments of the present invention will be apparent when viewed through a plane in which the CMP pad will be oriented during removal of material from the CMP pad.

As used herein, an "abrading surface or point" may be used to refer to a surface, edge, face, point or peak of an abrasive segment that contacts and removes material from a CMP pad. Generally speaking, the abrading surface or point is the portion of the abrasive segment that first contacts the CMP pad as the abrasive segment and the CMP pad are brought into contact with one another.

As used herein, "superhard" may be used to refer to any crystalline, or polycrystalline material, or mixture of such materials which has a Mohr's hardness of about 8 or greater. In some aspects, the Mohr's hardness may be about 9.5 or greater. Such materials include but are not limited to diamond, polycrystalline diamond (PCD), cubic boron nitride (cBN), polycrystalline cubic boron nitride (PcBN), corundum and sapphire, as well as other superhard materials known to those skilled in the art. Superhard materials may be incorporated into the present invention in a variety of forms including particles, grits, films, layers, pieces, segments, etc. In some cases, the superhard materials of the present invention are in the form of polycrystalline superhard materials, such as PCD and PcBN materials.

As used herein, "organic material" refers to a semisolid or solid complex or mix of organic compounds. As such, "organic material layer" and "organic material matrix" may be used interchangeably, refer to a layer or mass of a semisolid or solid complex amorphous mix of organic compounds, including resins, polymers, gums, etc. Preferably the organic material will be a polymer or copolymer formed from the polymerization of one or more monomers. In some cases, such organic material may be adhesive.

As used herein, the process of "brazing" is intended to refer to the creation of chemical bonds between the carbon atoms of the superabrasive particles/materials and the braze material. Further, "chemical bond" means a covalent bond, such as a carbide or boride bond, rather than mechanical or weaker inter-atom attractive forces. Thus, when "brazing" is used in connection with superabrasive particles a true chemical bond is being formed. However, when "brazing" is used in connection with metal to metal bonding the term is used in the more traditional sense of a metallurgical bond. Therefore, brazing of a superabrasive segment to a tool body does not necessarily require the presence of a carbide former.

As used herein, "particle" and "grit" may be used interchangeably.

As used herein, an "abrasive layer" describes a variety of structures capable of removing (e.g., cutting, polishing, scraping) material from a CMP pad. An abrasive layer can include a mass having several cutting points, ridges or mesas formed thereon or therein. It is notable that such cutting points, ridges or mesas may be from a multiplicity of protrusions or asperities included in the mass. Furthermore, an abrasive layer can include a plurality of individual abrasive particles that may have only one cutting point, ridge or mesa formed thereon or therein. An abrasive layer can also include composite masses, such as PCD pieces, segment or blanks, either individually comprising the abrasive layer or collectively comprising the abrasive layer.

As used herein, "metallic" includes any type of metal, metal alloy, or mixture thereof, and specifically includes but is not limited to steel, iron, and stainless steel.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, particle sizes, volumes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 micrometer to about 5 micrometers" should be interpreted to include not only the explicitly recited values of about 1 micrometer to about 5 micrometers, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

The Invention

The present invention generally provides pad conditioners and associated methods that can be utilized in conditioning (e.g., smoothing, polishing, dressing) or otherwise affecting a CMP pad to remove material from the CMP pad in order to provide a finished, smooth and/or flat surface to the pad. Pad conditioners of the present invention can be advantageously utilized, for example, in dressing CMP pads that are used in polishing, finishing or otherwise affecting silicon wafers.

It has now been discovered that improved CMP pad dressing can be accomplished using by alternating cutting and furrowing in the same dressing operation. Such can be accomplished by utilizing a CMP pad dresser having a dressing surface containing blade abrasive segments and particle abrasive segments arranged in an alternating fashion. Thus as the CMP pad dresser moves relative to the CMP pad, the surface of the CMP pad is alternately cut with the blade abrasive segments and furrowed with the particle abrasive segments.

Additionally, by alternating particle abrasive segments between adjacent blade abrasive segments, compression of the CMP pad by the blade abrasive segments is minimized. As an explanatory example, a CMP pad dresser having blade abrasive segments spaced far apart requires more downward compression into the pad to facilitate cutting as compared to a CMP pad dresser having blade abrasive segments closer together due to the upwelling of CMP pad material between the abrasive segments. A CMP pad dresser having abrasive segments positioned more closely together facilitates the cutting of the pad with less compression, thus reducing damage to the pad from overcutting. By alternating particle abrasive segments in between adjacent blade abrasive segments, the compression required to dress the CMP pad is reduced because upwelling of the pad material between the abrasive segments is minimized. Such a configuration is particularly effective when using CMP pads made from the soft materials required for many current delicate polishing procedures. Such soft materials are more effectively dressed using lower dresser compression due to the nature of the material which can experience high degrees of deformation when pressure from a dresser is applied. In one aspect, for example, the soft material can be about as soft as a conventional polyurethane pad. In another aspect, the soft material can be softer than a conventional polyurethane pad. In yet another aspect, the soft material can be at least about 10% softer than a conventional polyurethane pad. In a further aspect, the soft material can be at least about 25% softer than a conventional polyurethane pad. In yet a further aspect, the soft material can be at least about 50% softer than a conventional polyurethane pad. In one specific aspect, as is shown in FIG. 1, a CMP pad conditioner 10 is provided. The pad conditioner can include a plurality of blade abrasive segments 12 and a plurality of particle abrasive segments 14 positioned in an alternating arrangement on a pad conditioner substrate 16. Numerous alternating arrangements are contemplated, including, without limitation, the radial arrangement shown in FIG. 1. It is noted that the blade abrasive segments and the particle abrasive segment can be referred to herein collectively as the "abrasive segments" for the sake of simplicity. Similarly, the term "abrasive layer" may be used to refer collectively to blade abrasive layers and particle abrasive layers for simplicity sake.

The CMP pad conditioner can also include multiple annular rings of abrasive segments, as opposed to the single annular ring shown in FIG. 1. Furthermore, it should be noted that alternating abrasive segments would also include arrangements where grouped multiples of one or more abrasive segments were included in the pattern. For example, in one aspect the pattern of abrasive segments can include two or more blade abrasive segments alternating between each pair of particle abrasive segments. In another aspect the pattern of abrasive segments can include three or more blade abrasive segments alternating between each pair of particle abrasive segments. Additionally, in some aspects, multiple particle abrasive segments can be grouped and alternated in between blade abrasive segments or segment groups.

The pad conditioner substrate 16 can vary according to the applications for which the pad conditioner is designed, but in one aspect includes a face on which the abrasive segments can be affixed to allow the pad conditioner to be used to grind, plane, cut or otherwise remove material from a CMP pad (not shown). The abrasive segments can be permanently fixed to the pad conditioner 16 in an orientation that enables removal of material from the CMP pad by the abrasive layer as the pad conditioner and the pad are moved relative to one another. For example, as has been described and as shown in FIG. 1, the abrasive segments 12, 14 are arranged radially along an edge of a substantially circular pad conditioner substrate. Such an arrangement has been found well suited to remove material from a CMP pad (while "dressing" the pad) by rotating the pad conditioner substrate relative to the pad.

The present invention provides a number of advantages over conventional devices. One such advantage lies in the ability to customize methods of attachment of the abrasive layer to the segment blank independently of methods of attachment of the segment blank or blanks to the pad conditioner substrate. For example, as various attachment methods may involve very high temperatures and/or pressures, very demanding environmental conditions, or simply are very labor intensive when attempted with pad conditioners of large or complex surface areas, performing the attachment method on distinct, easily handled segment blanks can improve costs, efficiencies and integrities of the attachment process. Also, leveling of the components of the abrasive layer on each segment blank can be performed more easily when done in discrete, relatively small lots. The resulting plurality of abrasive segments can likewise be more easily positioned, leveled, spaced, oriented, etc., across the face of the pad conditioner substrate after the abrasive layer is individually attached to each of the abrasive segments.

In addition, by obtaining a plurality of abrasive segments, each with an abrasive layer already attached thereto, an abrasive pattern across the face of the pad conditioner substrate can be designed to optimize various conditioning procedures. For example, the spacing between adjacent abrasive segments can be carefully selected to aid in, or better control, the flow of various fluids (e.g., slurry) around and through the abrasive segments to increase the efficacy and efficiency of the material removing process. Also, as shown in FIG. 1, segment blanks having differing abrasive profiles (e.g., different sizes, shapes, abrasive aggressiveness, etc.) can be used on a single substrate, to enable customization of an abrading profile of the pad conditioner as a whole.

Figure 2A:
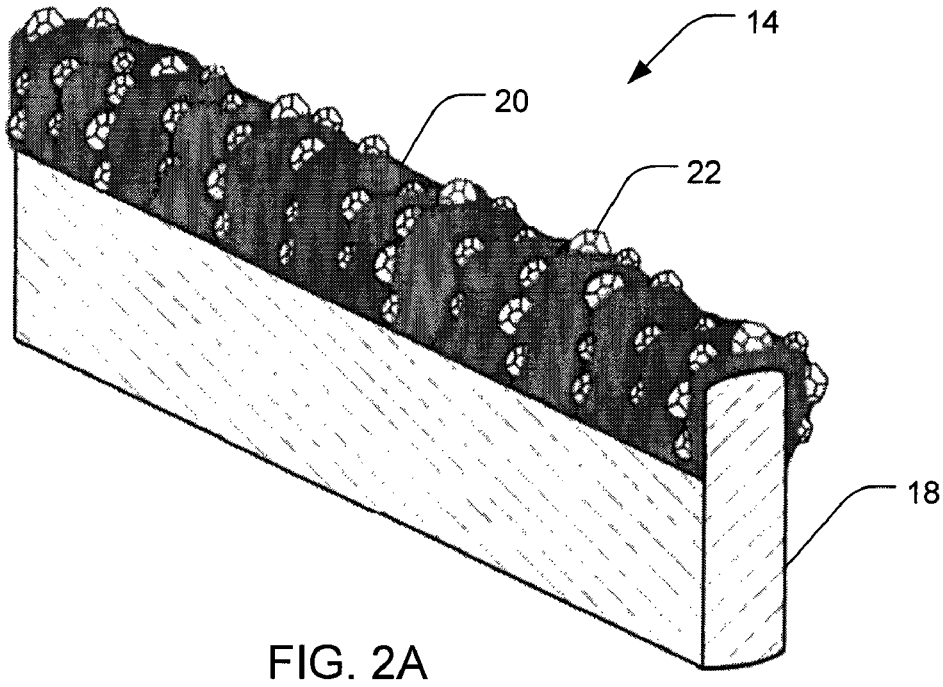
FIG. 2A is an enlarged, perspective schematic view of an exemplary abrasive segment that can be used in the pad conditioner of FIG. 1.

Numerous configurations of abrasive segments are contemplated, depending on the nature of the CMP pad and the desired dressing characteristics. In one aspect, as exemplified in FIG. 2A, each particle abrasive segment 14 can include a segment blank 18 and an abrasive layer 20 attached to the segment blank. The abrasive layer 20 can include a superhard abrasive material: in the exemplary embodiment of FIG. 2A, the superhard abrasive material includes a plurality of superabrasive particles 22.

Figure 2B:
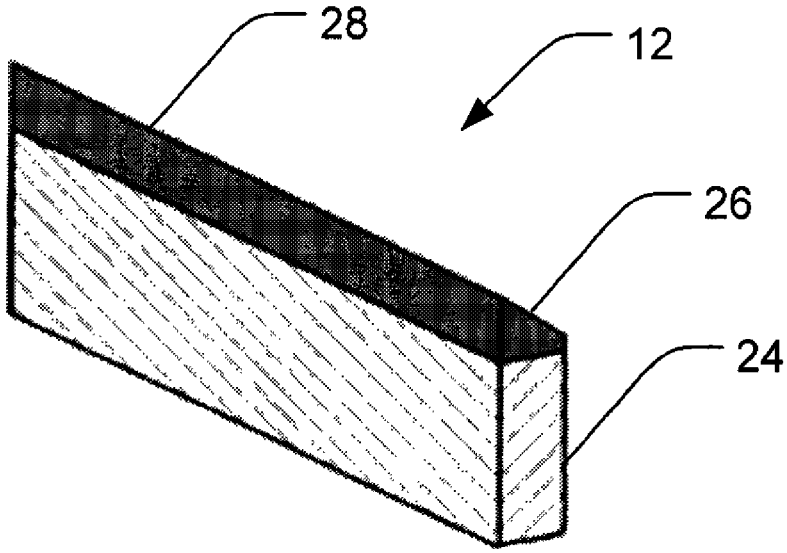
FIG. 2B is an enlarged, perspective schematic view of an exemplary abrasive segment that can be used in the pad conditioner of FIG. 1.
Figure 2C:
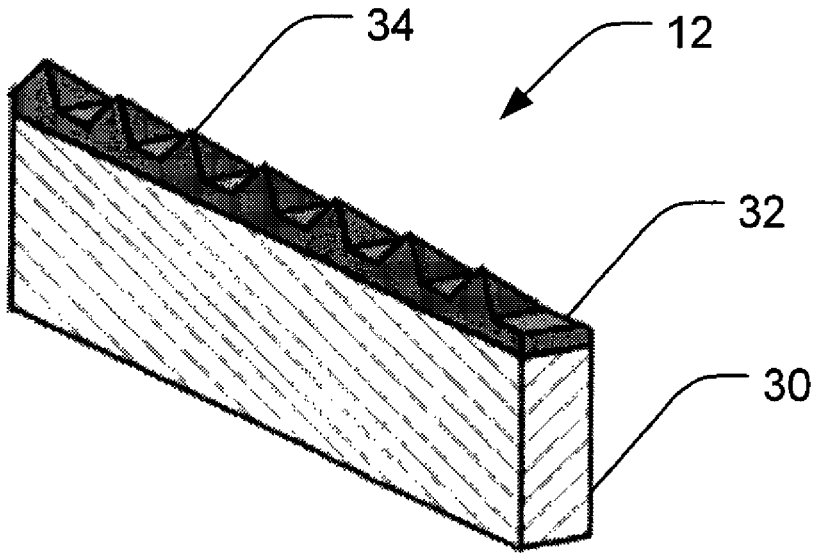
FIG. 2C is an enlarged, perspective schematic view of an exemplary abrasive segment that can be used in the pad conditioner of FIG. 1.

In another aspect, as exemplified in FIG. 2B, a blade abrasive segment 12 can include a segment blank 24 and an abrasive layer 26 attached to the segment blank as an elongate cutting blade. These blades can include a significantly longer length than a width, similar to blade of a conventional knife. In this aspect of the invention, the blade can be used to cut, scrape or carve a relatively wide swath of material from the CMP pad. The abrasive layer 26 of the blade abrasive segment includes a continuous cutting edge 28. In another aspect, as exemplified in FIG. 2C, a blade abrasive segment 12 can include a segment blank 30 and an abrasive layer 32 attached to the segment blank as an elongate cutting blade. In contrast to the aspect shown in FIG. 2B, the abrasive layer 32 of the blade abrasive segment includes a series of cutting teeth 34 formed in the abrasive layer. Further details regarding the construction and use of blade abrasive segments can be found in U.S. Provisional Patent Application Ser. No. 60/987,687, filed Nov. 13, 2007, which is hereby incorporated herein by reference.

Figure 3A:
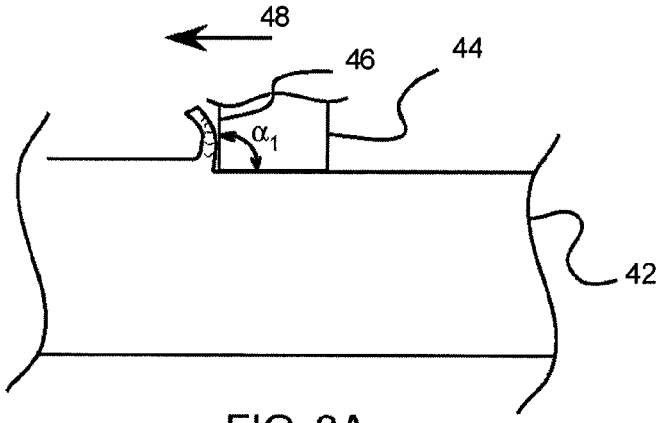
FIG. 3A is a side, schematic view of an abrasive segment having a cutting face shown removing material from a section of a CMP pad.
Figure 3B:
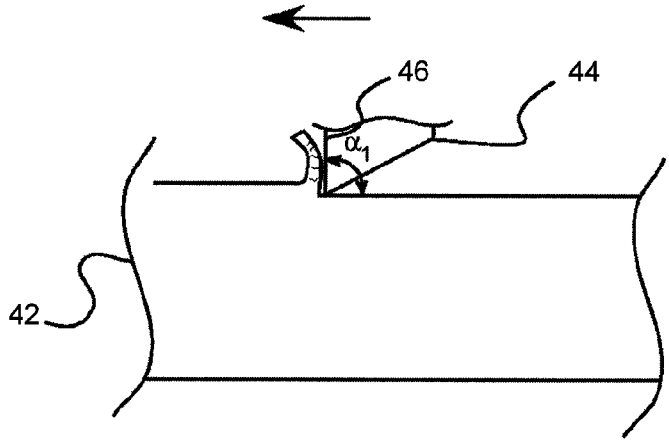
FIG. 3B is a side, schematic view of an abrasive segment having a differently configured cutting face shown removing material from a section of a CMP pad.
Figure 3C:
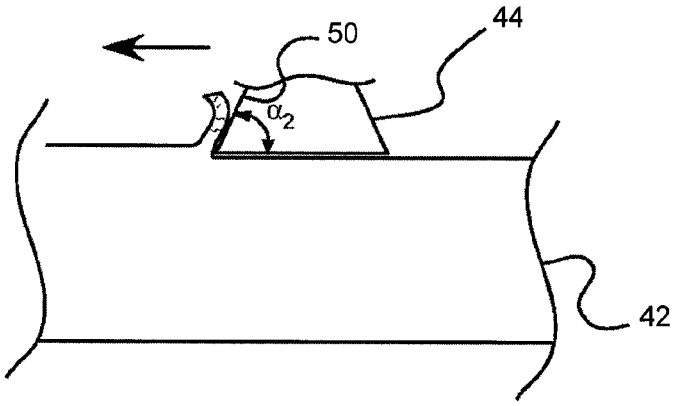
FIG. 3C is a side, schematic view of an abrasive segment having a differently configured cutting face shown removing material from a section of a CMP pad.

The cutting action of the blade abrasive segments is now shown to be advantageous to the dressing of a CMP pad. As is shown in FIGS. 3A-3C, for example, an embodiment is shown which aids in addressing issues relating to plastic deformation of a CMP pad (shown by example and in sectioned view at 42). This embodiment reduces the downward force required between the pad conditioner and the CMP pad. As a result, the CMP pad is left with a conditioned surface that is much more smooth and level than that obtained using conventional methods.

The conditioner shown in FIGS. 3A-3C can include abrasive layer 44 (only a section of which is shown). The abrasive layer can include a cutting face 46 angled at 90 degrees or less relative to a finished surface to be applied to the CMP pad (e.g., relative to movement of the cutting face away from the finished surface—sometimes referred to as a positive cutting angle). The face 46 of the abrasive layer 44 can be oriented such that relative movement of the pad conditioner (in the direction indicated at 48 in FIG. 3A) and the CMP pad 42 results in clean removal of material from the CMP pad with the cutting face to thereby condition the CMP pad.

By angling the cutting face 46 at 90 degrees or less, relative to a finished surface to be applied to the pad 42, the dressing process can cleanly shave a layer of pad material from the pad. The resultant surface applied to the pad can be safely used in the CMP process without damaging expensive silicon wafers. The present pad conditioners can be used to shave even a very shallow, thin layer of material from the pad and leave behind a clean, smooth and even finished surface on the pad. This technique can be used to remove thin layers of glaze that can be formed on the surface of the CMP pad.

The cutting face 46 is shown in FIGS. 3A and 3B oriented at an angle $\alpha_1$ of about 90 degrees relative to the finished surface to be applied to the CMP pad. Cutting face 50 of FIG. 3C is oriented at angle $\alpha_2$ that is less than 90 degrees relative to the finished surface to be applied to the CMP pad, on the order of about 60 degrees. The cutting faces can be oriented at a variety of angles, and in one embodiment vary from about 45 degrees to about 90 degrees relative to the finished surface of the CMP pad. It has been found that reducing the angle creates an even sharper cutting interface between the cutting element and the pad.

Those embodiments illustrated in the figures that include angled cutting faces each include a cutting face that is formed having the corresponding angle. In some embodiments, however, it is to be understood that a relatively normal (e.g., 90 degree) cutting face can be utilized, except that the abrasive segment on which the cutting face is formed can be "tilted" when attached to the substrate. In other words, the cutting face is not angled relative to the abrasive segment, rather angling of the abrasive segment results in angling of the cutting face. In this manner, an angled cutting face is provided without requiring that the referenced angle be formed on (or in) the abrasive segment.

Additional and varying abrasive segments for use in the present invention are also contemplated. For example, use is contemplated of the various cutting elements/abrasive segments detailed in U.S. patent application Ser. No. 11/357,713, filed Feb. 17, 2006, which is hereby incorporated herein by reference. In addition, formation of the abrasive layer on the segment blanks can be accomplished by way of a variety of techniques, including but not limited to vapor deposition techniques similar to those outlined in U.S. patent application Ser. No. 11/512,755, filed Aug. 29, 2006, which is hereby incorporated herein by reference. In addition, the abrasive segments can be formed utilizing ceramic components (as either or both the segment blank and/or the abrasive layer); electroplating techniques, etc.

Figure 4:
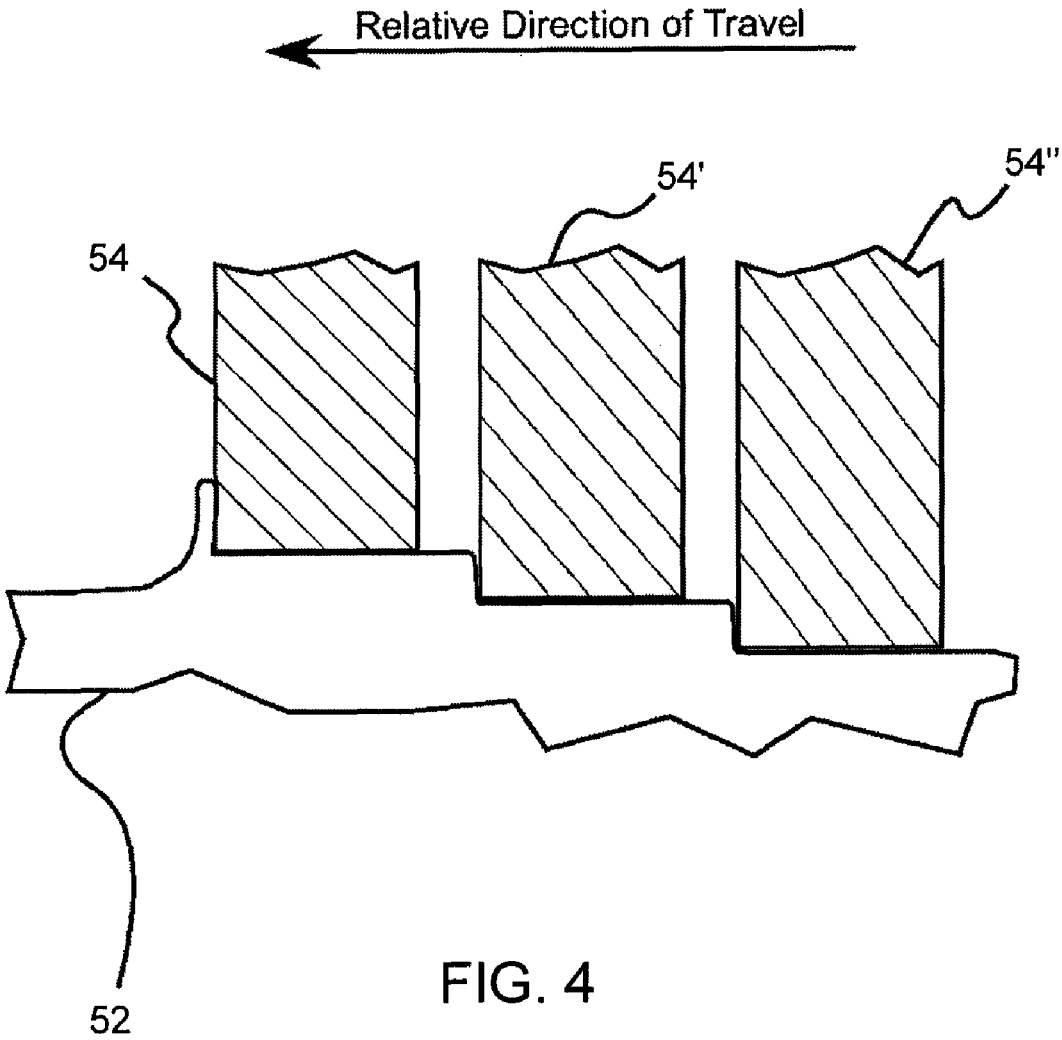
FIG. 4 is a schematic, side view of a portion of a CMP pad dresser having a series of abrasive segments arranged at varying elevations relative to one another.

In the embodiment illustrated in FIG. 4, a series of abrasive layers 54, 54' and 54" is provided, each of which includes a cutting tip oriented at a different elevation. In this aspect of the invention, the leading abrasive segment (of which abrasive layer 54 forms a part) is generally at a relatively higher elevation than are trailing abrasive layers 54' and 54", as the trailing layers would not otherwise contact pad material remaining after the leading blade has passed. The abrasive segments having abrasive layers 54, 54' and 54" can be formed in a variety of manners and in a variety of shapes, sizes and configurations, as detailed, for example, in U.S. Provisional Patent Application Ser. 60/988,643, filed Nov. 16, 2007, which is hereby incorporated herein by reference in its entirety. This embodiment can utilize intentionally cascaded cutting elements to achieve a desired abrading affect.

Numerous materials and methods of manufacturing are contemplated for constructing the CMP pad conditioners of the present invention. It should be noted that the materials and techniques disclosed herein are exemplary, and additional materials and techniques can be utilized without departing from the present scope.

The various segment blanks shown and discussed herein can be formed from a variety of materials, including, without limitation, metallic materials such as aluminum, copper, steel, metal alloys, etc., ceramic materials, glasses, polymers, composite materials, etc. Generally speaking, virtually any material to which an abrasive segment can be attached thereto will suffice.

In some embodiments, the material of the segment blank can be chosen to provide superior results during the process of attaching the abrasive layer thereto. The abrasive layer can be attached to the segment blank in a variety of manners, including epoxy bonding methods (e.g., organic bonding methods), metal brazing, sintering, electrodeposition, etc. The material of the segment blank can thus be chosen based upon the attachment process anticipated. For example, a segment blank formed partially or fully from nickel, or stainless steel, can be utilized in some processes involving brazing and/or sintering. Also, ceramic or metallic materials might be utilized in organic attachment methods.

Various embodiments of the invention employ various methods of attachment of the abrasive layer to the segment blank. In one aspect, an organic material layer can be deposited on the segment blank, and one or more abrasive particles, chips, segments, etc., can be fixed to the segment blank by way of the organic material layer. Examples of suitable organic materials include, without limitation, amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and mixtures thereof.

So-called "reverse casting" methods can be used to accurately and controllably orient and attach the abrasive material on the segment blank (and to orient and attach the segment blanks to the pad conditioner substrate). Such methods can include initially securing a superabrasive material, e.g., a plurality of superabrasive particles, to a substrate using a "mask" material. The portions of the particles protruding from the mask material can then be attached to a substrate, such as a segment blank, using the methods discussed herein, after which (or during which), the masking material can be removed.

Suitable reverse casting methods can be found in various patents and patent applications to the present inventor, including U.S. Patent Application Ser. No. 60/992,966, filed Dec. 6, 2007; U.S. patent application Ser. No. 11/804,221, filed May 16, 2007; and U.S. patent application Ser. No. 11/805,549, filed May 22, 2007, each of which is hereby incorporated herein by reference. These techniques can also be used when attaching the abrasive segments of the present invention to pad conditioner substrate in addition to attaching the abrasive layers of the present invention to the segment blanks. Such techniques allow very precise control of lateral placement of the abrasive segments or abrasive layers, as well as very precise control of relative elevation of the abrasive segments or abrasive layers.

When an organic bonding material layer is utilized, methods of curing the organic material layer can be a variety of processes known to one skilled in the art that cause a phase transition in the organic material from at least a pliable state to at least a rigid state. Curing can occur, without limitation, by exposing the organic material to energy in the form of heat, electromagnetic radiation, such as ultraviolet, infrared, and microwave radiation, particle bombardment, such as an electron beam, organic catalysts, inorganic catalysts, or any other curing method known to one skilled in the art.

In one aspect of the present invention, the organic material layer may be a thermoplastic material. Thermoplastic materials can be reversibly hardened and softened by cooling and heating respectively. In another aspect, the organic material layer may be a thermosetting material. Thermosetting materials cannot be reversibly hardened and softened as with the thermoplastic materials. In other words, once curing has occurred, the process can be essentially irreversible, if desired.

As a more detailed list of what is described above, organic materials that may be useful in embodiments of the present invention include, but are not limited to: amino resins including alkylated urea-formaldehyde resins, melamine-formaldehyde resins, and alkylated benzoguanamine-formaldehyde resins; acrylate resins including vinyl acrylates, acrylated epoxies, acrylated urethanes, acrylated polyesters, acrylated acrylics, acrylated polyethers, vinyl ethers, acrylated oils, acrylated silicons, and associated methacrylates; alkyd resins such as urethane alkyd resins; polyester resins; polyamide resins; polyimide resins; reactive urethane resins; polyurethane resins; phenolic resins such as resole and novolac resins; phenolic/latex resins; epoxy resins such as bisphenol epoxy resins; isocyanate resins; isocyanurate resins; polysiloxane resins including alkylalkoxysilane resins; reactive vinyl resins; resins marketed under the Bakelite™ trade name, including polyethylene resins, polypropylene resins, epoxy resins, phenolic resins, polystyrene resins, phenoxy resins, perylene resins, polysulfone resins, ethylene copolymer resins, acrylonitrile-butadiene-styrene (ABS) resins, acrylic resins, and vinyl resins; acrylic resins; polycarbonate resins; and mixtures and combinations thereof. In one aspect of the present invention, the organic material may be an epoxy resin. In another aspect, the organic material may be a polyimide resin. In yet another aspect, the organic material may be a polyurethane resin. In yet another aspect, the organic material may be a polyurethane resin.

Numerous additives may be included in the organic material to facilitate its use. For example, additional crosslinking agents and fillers may be used to improve the cured characteristics of the organic material layer. Additionally, solvents may be utilized to alter the characteristics of the organic material in the uncured state. Also, a reinforcing material may be disposed within at least a portion of the solidified organic material layer. Such reinforcing material may function to increase the strength of the organic material layer, and thus further improve the retention of the individual abrasive segments. In one aspect, the reinforcing material may include ceramics, metals, or combinations thereof. Examples of ceramics include alumina, aluminum carbide, silica, silicon carbide, zirconia, zirconium carbide, and mixtures thereof.

Additionally, in one aspect a coupling agent or an organometallic compound may be coated onto the surface of each superabrasive material to facilitate the retention of the superabrasive material in the organic material via chemical bonding. A wide variety of organic and organometallic compounds is known to those of ordinary skill in the art and may be used. Organometallic coupling agents can form chemicals bonds between the superabrasive materials and the organic material matrix, thus increasing the retention of the superabrasive materials therein. In this way, the organometallic coupling agent can serve as a bridge to form bonds between the organic material matrix and the surface of the superabrasive material. In one aspect of the present invention, the organometallic coupling agent can be a titanate, zirconate, silane, or mixture thereof. The amount of organometallic coupling agent used can depend upon the coupling agent and on the surface area of the superabrasive material. Oftentimes, 0.05% to 10% by weight of the organic material layer can be sufficient.

Specific non-limiting examples of silanes suitable for use in the present invention include: 3-glycidoxypropyltrimethoxy silane (available from Dow Corning as Z-6040); γ-methacryloxy propyltrimethoxy silane (available from Union Carbide Chemicals Company as A-174); β-(3,4-epoxycyclohexyl)ethyltrimethoxy silane, γ-aminopropyltriethoxy silane, N-(β-aminoethyl)-γ-aminopropylmethyldimethoxy silane (available from Union Carbide, Shin-etsu Kagaku Kogyo K.K., etc.).

Specific non-limiting examples of titanate coupling agents include: isopropyltriisostearoyl titanate, di(cumylphenylate) oxyacetate titanate, 4-aminobenzenesulfonyldodecylbenzenesulfonyl titanate, tetraoctylbis(ditridecylphosphite) titanate, isopropyltri(N-ethylamino-ethylamino) titanate (available from Kenrich Petrochemicals. Inc.), neoalkyoxy titanates such as LICA-01, LICA-09, LICA-28, LICA-44 and LICA-97 (also available from Kenrich), and the like.

Specific non-limiting examples of aluminum coupling agents include acetoalkoxy aluminum diisopropylate (available from Ajinomoto K.K.), and the like.

Specific non-limiting examples of zirconate coupling agents include: neoalkoxy zirconates, LZ-01, LZ-09, LZ-12, LZ-38, LZ-44, LZ-97 (all available from Kenrich Petrochemicals, Inc.), and the like. Other known organometallic coupling agents, e.g., thiolate based compounds, can be used in the present invention and are considered within the scope of the present invention.

Metal brazing can also be utilized to attach the abrasive layer to the segment blank. Metal brazing techniques are known in the art. For example, in fabricating a diamond particle abrasive segment, the process can include mixing diamond particles (e.g., 40/50 U.S. mesh grit) with a suitable metal support matrix (bond) powder (e.g., cobalt powder of 1.5 micrometer in size). The mixture is then compressed in a mold to form a desired shape. This "green" form of the tool can then be consolidated by sintering at a temperature between 700-1200 degrees C. to form a single body with a plurality of abrasive particles disposed therein. Finally, the consolidated body can be attached (e.g., by brazing) to a segment blank. Many other exemplary uses of this technology are known to those having ordinary skill in the art.

It should also be noted that various sintering methods can also be utilized to attach the abrasive layer to the segment blank. Suitable sintering methods will be easily appreciated by one of ordinary skill in the art having possession of this disclosure.

The abrasive layer can also be attached to the segment blank by way of known electroplating and/or electrodeposition processes. As an example of a suitable method for positioning and retaining abrasive materials prior to and during the electrodeposition process, a mold can be used that includes an insulating material that can effectively prevent the accumulation of electrodeposited material on the molding surface. Abrasive particles can be held on the molding surface of the mold during electrodeposition. As such, the accumulation of electrodeposited material can be prevented from occurring on the particle tips and the working surface of the pad conditioner substrate. Such techniques are described in U.S. patent application Ser. No. 11/292,938, filed Dec. 2, 2005, which is hereby incorporated herein by reference.

One or more apertures can extend through the insulating material to allow for circulation of an electrolytic fluid from an area outside the mold through the mold and to the surface of the pad conditioner substrate in order to facilitate electrodeposition. Such circulation can be advantageous as it is generally necessary to keep a sufficient concentration of ions in an electrolytic fluid at the location of electrodeposition. Other well known techniques can also be utilized, it being understood that the above-provided example is only one of many suitable techniques.

The segment blank can similarly be attached to the pad conditioner substrate in a variety of manners. Depending upon the material from which the segment blank is formed, various manners of fixing the segment blank to the pad conditioner substrate may be utilizing. Suitable attachment methods include, without limitation, organic binding, brazing, welding, etc.

The geometric configuration of a given abrasive segment can vary. For example, in one aspect the abrasive segment can include a generally rectangular or trapezoidal segment blank with a layer of abrasive material attached to an upper portion thereof. The size of the segment blank can vary. In one aspect of the invention, segment blank size can be adjusted to achieve uniform distribution of diamond particles and/or cutting blades about an annular ring array. In the case of particle abrasive segments, each segment can contain a plurality of diamond particles with pitch set from 3× to 10× of the diamond size. Smaller segments can be better distributed to share the loading during dressings.

The modular nature of the present systems allows a great deal of flexibility in attaching the abrasive layer to the segment blanks. As the segment blanks can be prepared separately from the pad conditioner substrate, a variety of manufacturing advantages can be realized when applying the abrasive layer to the segment blank, without regard to the size, shape, mass, material, etc., of the pad conditioner substrate to which the segment blanks will eventually be attached.

In one aspect, the abrasive segments arranged about the face of the conditioner substrate can each be substantially the same in size, shape, abrasive composition, height relative to one another, etc. In other embodiments, the size, shape, abrasive composition, height relative to one another, etc., can be purposefully varied, to achieve optimal design flexibility for any particular application. Also, each of the afore-mentioned qualities can be varied from one segment to another: e.g., alternating segments can include PCD abrasive pieces, chips or slats, with adjacent segments including abrasive particles.

The retention of abrasive segments on the pad conditioner substrate can be improved by arranging the abrasive segments such that mechanical stress impinging on any individual abrasive segment is minimized. By reducing the stress impinging on each abrasive segment they can be more readily retained in place on the substrate, particularly for delicate tasks. Minimizing of stress variations between segments can be accomplished by spacing the segments evenly (or consistently) from one another, leveling to a uniform height (relative to the face of the pad conditioner substrate) an uppermost portion of each segment, radially aligning the segments about the face of the pad conditioner substrate, etc. Various other height and spacing techniques can be utilized to obtain a desired affect.

In one embodiment of the invention, the spacing of the abrasive segments can be adjusted to alter the contact pressure of the contact portion (e.g., the portion of the segment that engages and removes material from the CMP pad) of each segment. In general, the farther the segments are spaced from one another, the higher the contact pressure between the segment and the CMP pad. Thus, a higher density of abrasive segments across the face of the pad conditioner substrate can, in some cases, provide a more desirable abrasive interface between the pad conditioner substrate and the CMP pad. In other applications, a lower density of abrasive segments may be beneficial. In either case, the present invention provides a great deal of design flexibility to obtain the optimal abrading profile.

By forming the abrasive segments in individual units having defined geometric shapes, arrangement of the abrasive segments in a very precise manner becomes much easier. As the defined geometric shapes can be replicated fairly precisely from one abrasive segment to another, the positioning of, and accordingly, the stress impinged upon, each abrasive segment can be accomplished fairly consistently across the face of the pad conditioner substrate in question. With prior art abrasive grits, for example, the overall shape and size of each a plurality of grits might change considerably from one grit to another, making precise placement of the grits difficult to accomplish. This problem is adequately addressed by the advantageous features of the present invention.

It has been found that diamond pad conditioners used commercially normally contain about ten thousand diamond particles. Due to the distortion of the substrate, particularly when the disk is manufactured by a high temperature process (e.g. by brazing), and also the distribution of particle sizes and diamond orientations, the cutting tips are located at different heights. When they are pressed against a polishing pad, only about 1% of the protruded diamond can be in engagement with a pad. This can increase the stress on the diamond cutting most deeply into the pad, and the diamond may break and cause catastrophic scratching of the expensive wafers.

By utilizing the reverse casting methods as described above, the height difference of between particles can be greatly reduced. In one aspect of the invention, abrasive segments are set on a flat metal (e.g. stainless steel) mold with designed spacing in a retainer ring. Epoxy with hardener fully mixed can be poured into the retainer ring to fill up and cover all segments. The diamond grits on the mold can be shielded by the penetration of the epoxy flow. After curing (with or without heating), the retainer ring and the mold can be removed. The diamond segments are thereby firmly embedded in the epoxy matrix. Due to the leveling of diamond by the flat mold, the tip height variations of the tallest diamond grits are minimized.

EXAMPLES

The following examples present various methods for making the pad conditioners of the present invention. Such examples are illustrative only, and no limitation on the present invention is to be thereby realized.

Example 1

A pad conditioner was formed by first arranging diamond grit (e.g. 50/60 mesh) on a stainless steel flat mold (also, a slightly convex or contoured mold can be utilized) having a layer of adhesive (e.g. acrylic). A hard rubber material was used to press individual diamond grits into the adhesive while tips of the grits were leveled by the flat mold. A mixture of epoxy and hardener was then poured onto the grit protruding outside the adhesive (a containment ring oriented outside the mold can retain the epoxy). After curing, the mold was then removed and the adhesive was peeled away. The remaining ODD contains diamond grit protruding outside a solidified epoxy substrate. The back of the epoxy can be machined and the disk adhered to a stainless steel (e.g. 316) plate with fastening holes for mounting on a CMP machine.

Example 2

A pad conditioner was formed by radially arranging serrated PCD blades. As in the previous example, the teeth of the PCD blade were leveled with a mold that can be positioned either on the bottom or on the top of the pad conditioner. Epoxy was then cast as in the previous example. In the case that the mold is on the top, the blades are pressed slightly into the slot of a substrate and the slot is sealed by epoxy or silicone.

Example 3

A composite design married the embodiments of Example 1 and Example 2 discussed above. This design leverages the many cutting tips of Example 1 with the cutting efficiency of Example 2. In this Example 3, smaller organic abrasive segments were formed by using a fiber reinforced polymer that is generally harder than epoxy. The organic segments were then radially arranged about a pad conditioner substrate with the blades of Example 2 interspersed therebetween. The cutting tips of the blades were leveled so as to be about 20 microns higher than were the tips of the organic abrasive segments. In this manner, the penetration depth of blade cutting teeth is controlled, while the organic cutting teeth play a secondary role in dressing the pad with the effect of removing glaze and also grooving the pad.

It is to be understood that the above-described arrangements are only illustrative of the application of the principles of the present invention. Numerous modifications and alternative arrangements may be devised by those skilled in the art without departing from the spirit and scope of the present invention and any appended or following claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A CMP pad conditioner, comprising:

a plurality of blade abrasive segments, each blade abrasive segment including:

an elongated blade segment blank; and an abrasive layer attached to the blade segment blank, the abrasive layer including a superhard abrasive material;

a plurality of particle abrasive segments, each particle abrasive segment including:

a particle segment blank; and an abrasive layer attached to the particle segment blank, the abrasive layer including a plurality of superabrasive particles; and a pad conditioner substrate;

each of the plurality of blade abrasive segments and the particle abrasive segments being permanently affixed to the pad conditioner substrate in an alternating pattern and in an orientation that enables removal of material from a CMP pad by the abrasive layers as the pad conditioner and the CMP pad are moved relative to one another.

2. The pad conditioner of claim 1, wherein a longitudinal axis of each of the plurality of blade abrasive segments is aligned along a radius of the pad conditioner substrate.

3. The pad conditioner of claim 1, wherein each of the abrasive layers includes an abrading surface or point, and wherein the abrading surfaces or points are leveled relative to one another such that no abrading surface or point protrudes above another abrading surface or point by more than about 30 microns.

4. The pad conditioner of claim 1, wherein the plurality of blade abrasive segments are radially distributed about a face of the pad conditioner substrate.

5. The pad conditioner of claim 1, wherein the abrasive layers of the blade abrasive segments comprise polycrystalline diamond blades.

6. The pad conditioner of claim 5, wherein at least a portion of the abrasive layers of the blade abrasive segments have a serrated cutting edge.

7. The pad conditioner of claim 5, wherein at least a portion of the abrasive layers of the blade abrasive segments are have a flat cutting edge.

8. The pad conditioner of claim 1, wherein an alternating pattern includes single blade abrasive segments alternating between particle abrasive segments.

9. The pad conditioner of claim 1, wherein an alternating pattern includes a group of two or more blade abrasive segments alternating between particle abrasive segments.

10. The pad conditioner of claim 1, wherein the abrasive layers of the particle abrasive segments include individual abrasive particles.

11. The pad conditioner of claim 1, wherein the plurality of abrasive layers are attached to the blade segment blanks and the particle segment blanks with an organic material layer including a member selected from the group consisting of: amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and combinations thereof.

12. The pad conditioner of claim 1, wherein the abrasive layers are attached to the blade segment blanks and the particle segment blanks with a brazing alloy.

13. The pad conditioner of claim 1, wherein the plurality blade abrasive segments and particle abrasive segments are attached to the conditioner substrate with an organic material layer including a member selected from the group consisting of: amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and combinations thereof.

14. The pad conditioner of claim 1, wherein the plurality blade abrasive segments and particle abrasive segments are attached to the conditioner substrate with a brazing alloy.

15. A method of conditioning a CMP pad surface, comprising:

moving a dresser surface and the CMP pad surface relative to one another, such that the dresser surface alternately shaves and furrows the CMP pad surface.

16. A method of forming a CMP pad conditioner, comprising:

positioning a plurality of blade abrasive segments and a plurality of particle abrasive segments as in claim 1 in an alternating arrangement on a face of a pad conditioner substrate in an orientation that enables removal of material from a CMP pad by the abrasive layers as the pad conditioner and the CMP pad are moved relative to one another; and permanently affixing the plurality of blade abrasive segments and the plurality of particle abrasive segments to the pad conditioner substrate.

17. The method of claim 16, wherein the plurality of blade abrasive segments and the plurality of particle abrasive segments are attached to the conditioner substrate with an organic material layer including a member selected from the group consisting of: amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and combinations thereof.

18. The method of claim 16, wherein the plurality of blade abrasive segments and the plurality of particle abrasive segments are attached to the conditioner substrate with a brazing alloy.

19. The method of claim 16, wherein the plurality of blade abrasive segments and the plurality of particle abrasive segments are leveled with respect to one another using a reverse casting technique.

20. A method of conditioning a CMP pad, comprising:

pressing a CMP pad dresser into a CMP pad;

moving the CMP pad dresser and the CMP pad relative to one another, such that compression of the CMP pad dresser into the CMP pad is minimized due to an alternating arrangement of blade abrasive segments and particle abrasive segments affixed to the CMP pad dresser.

* * * * *